US005778978A

United States Patent [19]

Crow

[11] Patent Number: 5,778,978

[45] Date of Patent: Jul. 14, 1998

[54] EXTERIOR WIRELINE CABLE ADAPTER SUB

[75] Inventor: Joseph Michael Crow, Broussard, La.

[73] Assignee: Pipe Recovery Services, L.L.P., New Iberia, La.

[21] Appl. No.: 692,528

[22] Filed: Aug. 6, 1996

[51] Int. Cl.[6] ..... E21B 49/00

[52] U.S. Cl. ..... 166/254.2; 166/378; 166/66

[58] Field of Search ..... 166/254.1, 254.2, 166/264, 377, 378, 373, 385, 66

[56] References Cited

U.S. PATENT DOCUMENTS

| | | | |
|---|---|---|---|
| 4,560,000 | 12/1985 | Upchurch | 166/55.1 |
| 4,669,537 | 6/1987 | Rumbaugh | 166/113 |
| 4,790,378 | 12/1988 | Montgomery et al. | 166/66 |
| 5,044,437 | 9/1991 | Wittrisch | 166/250 |
| 5,361,839 | 11/1994 | Cox | 166/120 |
| 5,375,659 | 12/1994 | Gilbert et al. | 166/264 |
| 5,495,755 | 3/1996 | Moore | 166/254.2 X |

*Primary Examiner*—Frank Tsay
*Attorney, Agent, or Firm*—Bush, Riddle & Jackson

[57] ABSTRACT

A system for use in running and operating an electric wireline well tool in a well on coiled tubing includes tubular adapter and connector subs connected end-to-end between the lower end of the tubing and the upper end of the well tool. The armored electric cable extends down along the outside of the tubing, enters the adapter sub through a window in the side thereof, and is anchored within the connector sub where its conductors are electrically connected to the well tool. The tubing and wireline cable can be run into the well under pressure. A system for retrieving an electric wireline well tool using a retrieving tool on the lower end of coiled tubing also is disclosed.

19 Claims, 3 Drawing Sheets

FIG. 5
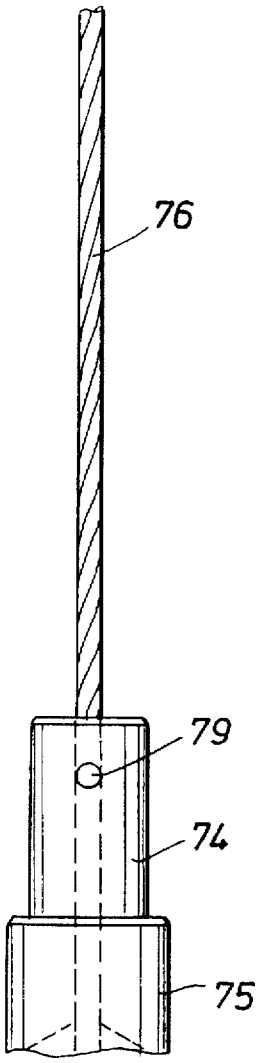
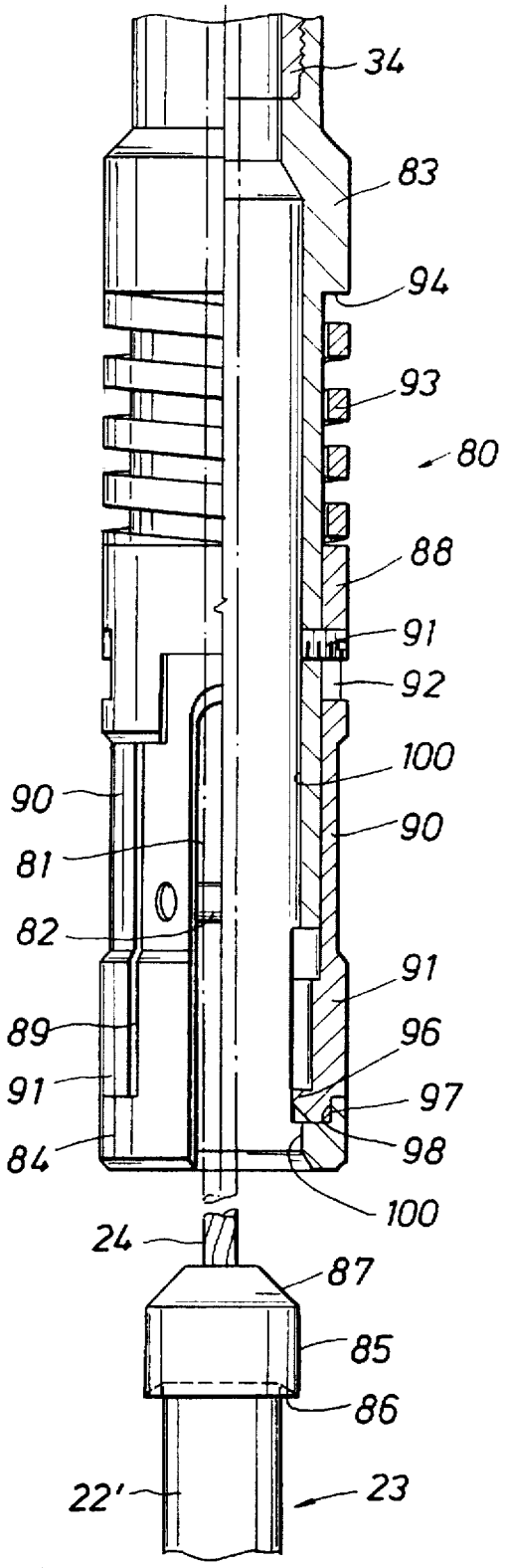
FIG. 6

EXTERIOR WIRELINE CABLE ADAPTER SUB

FIELD OF THE INVENTION

This invention relates generally to a new and improved adapter sub and system that allows an electric wireline tool to be run on coiled or other tubing with the armored cable extending on the outside of such tubing, and particularly to a connector system of the type described where the cable extends through a side opening in a tubular sub which attaches the wireline tool to the lower end of the tubing.

BACKGROUND OF THE INVENTION

Where a well tool such as a casing cutter, free point indicator, perforating gun or a logging tool or the like which requires electrical power or an electrical signal for its operation is run on coiled tubing that is wound on the large storage reel of a surface unit, the usual practice is to position the armored cable in the bore of the entire length of such tubing before it is wound onto the reel. An electrical connection with brush-type contacts is used at the center of the reel to provide electrical connections with the conductor or conductors inside the cable. Although this system allows electrically operated well tools to be employed in certain circumstances where a tool suspended on a cable alone may be very difficult if not impossible to use, for example in a highly deviated well, the placement of the wireline cable in the coiled tubing is difficult and time consuming. Moreover, the electrical connections are peculiar to the particular size of tubing that might be used. The rig-up at the well also is complicated and time consuming, and in the event that the wireline tool gets stuck in the well for some reason, it can be difficult to release the lower end of the tubing and the cable to enable them to be recovered by winding back onto the reel at the surface.

The general object of this invention is to provide a new and improved connector and adapter system that allows an electric wireline-type well tool to be run on tubing with the armored cable extending along the outside of the tubing to eliminate the various problems with prior systems noted above.

SUMMARY OF THE INVENTION

This and other objects of the present invention are attained through the provision of a unique adapter sub that connects the lower end of a coiled or other type of tubing to a connector sub that is attached to the top end of the wireline tool. The adapter sub is a generally tubular member having a central bore that is opened to the outside by an elongated slot through which the armored electric cable extends. The lower end portion of the cable extends down into the upper portion of the connector sub and through a mandrel where the armor wires of the cable are anchored. The core of the cable, which has one or more electrical conductors embedded therein, extends below the mandrel to where the conductor(s) is connected to the wireline tool by a suitable plug.

A side entry housing is used at the surface to allow the armored cable to be anchored to the connector sub and then fed in alongside the coiled tubing as it is forced into the well under pressure. The adapter and connector subs can be threaded to one another, or coupled by shear pins to allow emergency release. The present invention allows the same wireline cable to be run in with any size tubing, and without using different and special sizes and configurations of electrical connectors at the surface. In one embodiment of the invention, the wireline tool can be released from the lower end of the tubing to allow its removal from the well, leaving the wireline tool suspended on the cable. In another embodiment, a retrieving tool can be run on tubing and automatically latched to the wireline tool downhole to assist in removal of the tool from the well.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which:

FIG. 5 is an elevational view showing the connector sub, wireline tool and cable after release; and FIG. 6 is a longitudinal sectional view, with portions in side elevation, of still another embodiment of this invention.

DETAILED DESCRIPTION OF A PREFERRED EMBODIMENT

Figure 1:
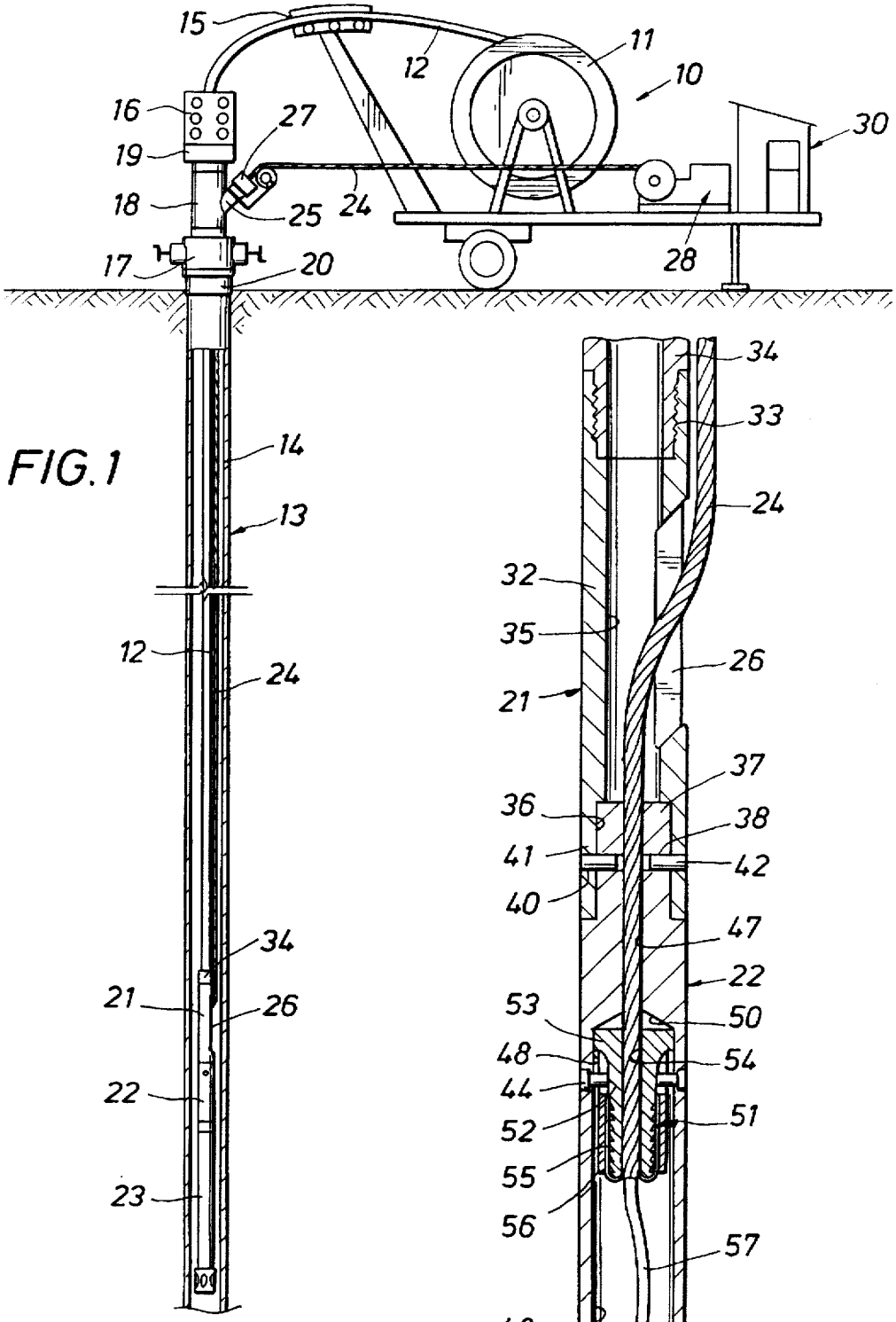
FIG. 1 is a schematic view of an electrically controlled well tool being run into a well on coiled tubing and with the armored cable on the outside thereof.

Referring initially to FIG. 1, a unit 10 having a reel 11 on which a length of continuous coiled tubing 12 is wound is shown stationed near a well 13 that typically has been cased at 14. The tubing 12 passes over a guide 15 and down into an injector 16 having a traction drive that forces the tubing into the well 13 under pressure via a stripper 19, a side entry sub 18 and a blowout preventer 17 that are connected to the top of the wellhead 20. The unit 10 can be controlled from a station 30. The lower end of the coiled tubing 12 is attached by a coupling 34 to an adapter sub 21 that is constructed in accordance with this invention, and the sub 21 is attached to the upper end of a connector sub 22 which is fixed to the upper end of a wireline tool 23. The tool 23 can be any one of various devices mentioned above, and which is controlled or operated by electric current or signals from the surface. For this purpose an electric logging cable 24 having armor wires around a central core that has one or more electrical conductor wires embedded therein, is fed through an upwardly inclined entry tube 25 of the sub 18 and down alongside the coiled tubing 12 to the adapter 21. There the cable 24 passes into the bore of the adapter 21 through a side opening 26 and down into the connector sub 22 where the armor wires are anchored in a manner to be described below. The side entry tube 25 has a stuffing box 27 on its outer end so that the cable 24 can be run and retrieved under pressure. The cable 24 passes over a guide sheave and then to the winch of a wireline unit 28 which, for convenience of illustration, is shown on the coiled tubing unit 10. However the unit 28 typically is located and controlled separately.

Figure 2:
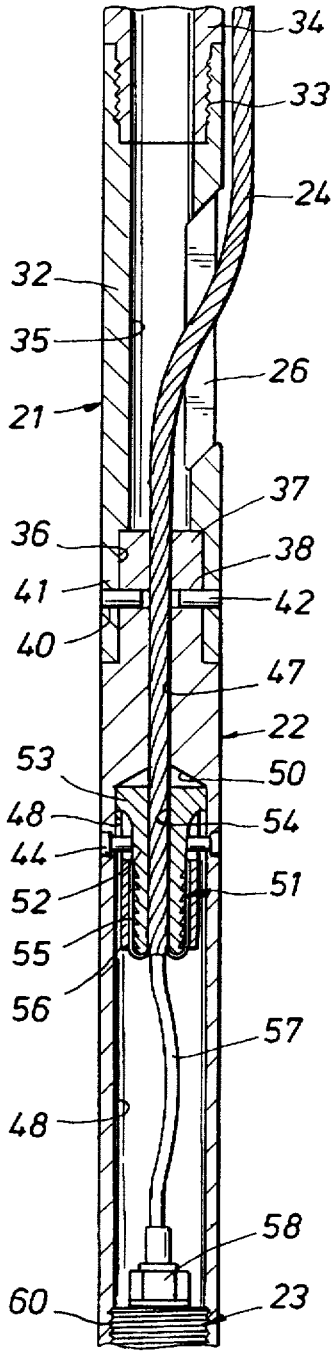
FIG. 2 longitudinal sectional view of the combination adapter and connector subs of the present invention.

As shown in detail in FIG. 2, the adapter sub 21 is formed by a tubular body 32 having threads 33 at its upper end by which it is attached to a coupling member 34 on the lower end of the coiled tubing 12. The bore 35 of the sub 21 is enlarged in diameter at 36 and sized to fit over the reduced diameter upper end portion 37 of the connector sub 22. A plurality of radial bores 38 in the portion 37 are aligned with companion holes 40 in the lower portion 41 of the body 32 when the portions are fitted together to allow insertion of shear pins 42 which releasably couple the subs 21 and 22 to one another. If a rigid coupling is desired, internal threads (not shown) on the portion 41 can be screwed to mating threads on the outside of the connector sub 22. The elongated side opening 26 in the body 32 is formed by a longitudinal slot or window through the well thereof as shown, and the upper and lower ends of the slot preferably incline downward and inward.

The connector sub 22 is generally tubular and has a cylindrical passage 47 that extends downwardly through the upper portion 37 and into an enlarged diameter bore 48 that extends to the lower end of the sub. A conical surface 50 joins the passage 47 to the bore 48 and provides a downwardly facing stop shoulder. A cable anchor assembly indicated generally at 51 is mounted in the upper part of the bore 48 and held by set screws 44. The assembly 51 includes a mandrel 52 having an outwardly directed flange 53 at is upper end, and a central passage 54 that is axially aligned with the passage 47. The lower end surface of the mandrel 52 is rounded somewhat, and a section of upwardly facing teeth 55 is formed on the exterior of the mandrel. A sleeve 56 surrounds the teeth 55 and is mounted on the outside of the mandrel 52 below the flange 53.

The electric logging cable 24 extends through the window 26 and into the bore 35, and then passes down through the passages 47 and 54. At a suitable distance below the lower end of the mandrel 52 the armor wires of the cable 24 are cut and bent back upward so that their end portions can be forced into the annular space between the teeth 55 and the inner surface of the sleeve 56. The teeth 55 then grip the wire end portions to anchor the cable and thereby prevent it from being withdrawn from the passages 54 and 47. The core 57 of the cable 24 which is exposed below the anchor mandrel 52 extends down through the bore 46 and to a suitable waterproof electrical connection 58 on the wireline tool 23. The lower end of the connector sub 22 is rigidly attached to the upper end of the wireline tool 23 by threads 60.

Figure 3:
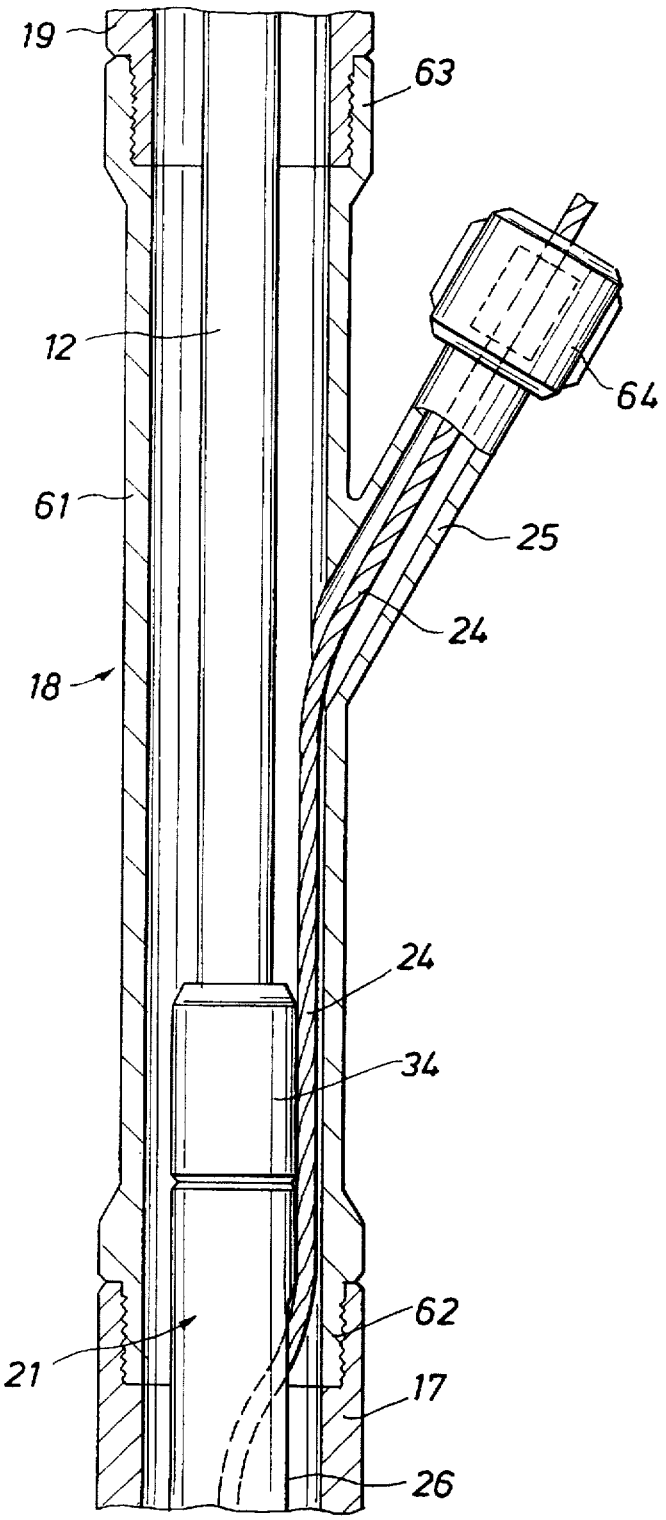
FIG. 3 is an enlarged and somewhat schematic view of a side entry sub that is used to feed the armored cable into the well at the surface.

FIG. 3 provides a schematic view of the side entry assembly 18 which is used at the surface to enable the wireline cable 24 to be run with and alongside the coiled tubing 12. The assembly 18 has a relatively large diameter tubular body 61 with a threaded pin 62 at its lower end, and a threaded box 63 at its upper end. The joints 62, 63 allow the side entry assembly 18 to be rigidly connected between the blowout preventer 17 and the stripper 19. The cable 24 extends into the assembly 18 through the stuffing box 27 so that the cable can and retrieved under pressure.

Figure 4:
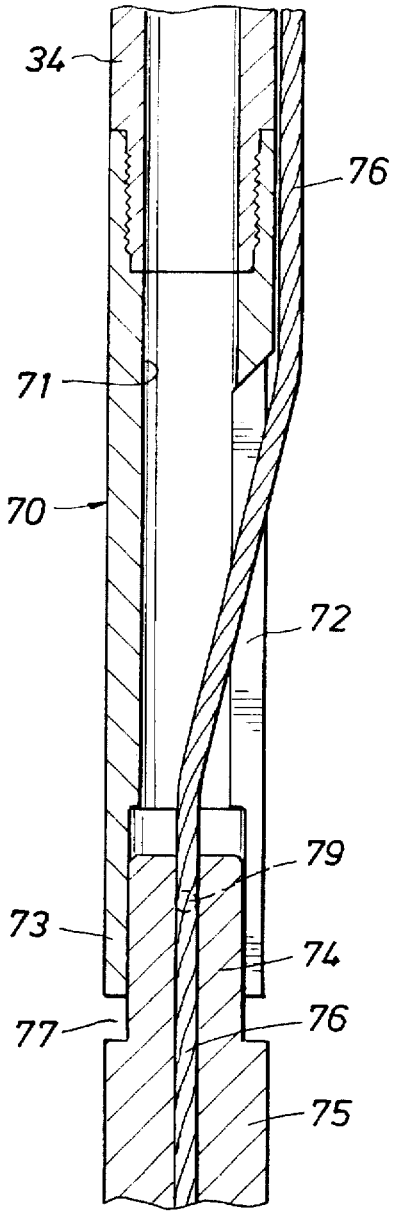
FIG. 4 is a cross-sectional view of another embodiment of the present invention where the wireline tool and cable can be released from the tubing.

Another embodiment of the present invention is shown in FIGS. 4 and 5. As in the previous embodiment, the generally tubular adapter sub 70 that is attached to the lower end of the coiled tubing 12 by the threaded coupling 34 has a central bore 71 that is opened to the outside by an elongated radial slot 72. The slot 72 opens downward through the lower end portion 73 of the sub 70, which is partially telescoped over the upper end portion 74 of the connection sub 75. The armored cable 76 extends through the window or slot 72 and down into the central passage of the connector sub 75. The armor wires of the electric logging cable 76 are anchored in sub 25 as previously described and shown in FIG. 2. The upper end portion 74 of the connector sub is releasably secured to the adapter sub 70 by means such as a pair of radial shear pins 76 that are positioned in aligned holes in the portions 73 and 74. The holes for the pins 76 are located such that there is an axial clearance space 77 so that an upward pull on the cable 76 can be employed to shear the pins 76 at a predetermined tension.

Once the pins 76 are sheared, the cable 76 can be lowered to the surface to removed the sub portion 74 from within the lower section 73 or the adapter sub 20. When that occurs the cable 76 will move entirely out of the slot 72 so that the sole means of suspension of the wiretool 23 is the cable 76 as shown in FIG. 5. Then the coiled tubing 12 can be removed from the well casing 14 by operation of the surface unit 10.

Still another embodiment of the present invention is shown in FIG. 6. Here the electric wireline tool 23 has been run into the well 13 on an armored cable 24, but a difficulty has been encountered in being able to retrieve the tool. For example there may be high friction or drag on the cable 24 in the case of a deviated well or in open hole, or a casing or tubing problem causes the tool to hang up. The structure shown in FIG. 6 allows the lower end of the coiled tubing 12 to be connected to the tool 23 so that the tubing is used to retrieve the tool under these circumstances. In accordance with this aspect of the present invention, a fishing tool or grapple 80 which is attached to the lower end of the coiled tubing 12 has an opened-bottomed longitudinal slot 81 therein through which the cable 24 is threaded at the surface. A transverse retaining pin 82 below the upper end of the slot 81 prevents the cable 24 from coming out of the slot as the tool 80 and the coiled tubing 12 are lowered into the casing alongside the cable.

The fishing tool 80, which has numerous features that are typical of such devices, includes a generally tubular housing or barrel 83 having its upper end adapted to be connected in a suitable manner to the coupling 34 on the lower end of the coiled tubing 12. Several rectangular windows 89 are formed through the walls of a thickened lower end section 84 of the housing, and the internal bore 100 of this section is sized to fit easily over a retrieving head 85 on the upper end of a connector sub 22' of the type described above in connection with FIG. 2. In this case the head 85 is formed with a downwardly facing, undercut annular shoulder 86, and a conical cam surface 87 above the undercut shoulder.

A catch sleeve 88 having a plurality of depending, resilient fingers 90 is mounted for limited longitudinal movement on the housing 83, with the limits of such movement being defined by engagement of diametrically opposed pins 91 with the opposite ends of elongated slots 92. A coil spring 93 that reacts between the upper end of the sleeve 88 and a shoulder 94 on the housing 83 biases the catch sleeve 88 downward. Each spring finger 90 has an enlarged diameter latch head 91 on its lower end that is positioned in a respective window 89 in the lower end section 84 of the housing 83. Each head 95 has an arcuate catch shoulder 96 near its lower end and is arranged such that when its finger 90 is relaxed, the inner edge of the shoulder 96 extends somewhat into the bore 100 of the housing section 84. In such inner position an outer surface 97 of each shoulder 96 is captured in a recess 98 near the lower end of the housing section 84 to lock the head in its inner position.

In accordance with one aspect of this invention, the housing 83 is formed with the elongated, longitudinally extending slot 81 that opens through its lower end in order to open a substantial length of its bore 100 to the outside. The width of the slot 81 is greater than the diameter of the cable 24, and the upper ends of the slot preferably is inclined upward and outward as shown. The transverse retaining pin 82 extends across the slot 81 and has its end portions mounted in aligned holes that are formed in the walls of the housing 83 near the opposite sides of the slot 81.

Where difficulty is encountered in retrieving a wireline tool that has been run on the armored cable 24, the tool 80 is attached to the lower end of the coiled tubing 12 at the surface. With the pin 102 removed, an adjacent portion of the armored cable 24 is pushed into the bore 100 of the housing 83 via the slot 81 so as to extend out the lower end of the bore and then to the outside of the tool 80 at the top of the slot as shown in dash-dot-dash lines. Then the retaining pin 102 is mounted, as shown, to keep the cable from disengaging from the slot. After the side entry sub 18 is rigged up as shown in FIG. 1, the coiled tubing 12 is forced into the well 13 by the traction drive 16. As the tool 80 moves down into the well on the lower end of the coiled tubing 12, the cable 24 is constrained to the thread through the bore 100 and pass to the outside above the guide pin 102.

When the tool 80 encounters the head 85 of the wireline tool 23, the head goes into the lower section 84. The cam surface 87 engages the catch shoulders 96 and moves the sleeve 88 relatively upward against the bias of the coil spring 93. When the lower surfaces 97 of the latch heads 91 disengage from the locking recess 98, the latch heads are shifted radially outward by the cam surface 87 to allow the undercut shoulder 86 to move upward past the catch shoulders 96. At this point the heads 95 are shifted inward by the resilience of the spring fingers 90 to engage the shoulders 96 below the undercut shoulder 86, and the coil spring 93 extends to force the sleeve 88 and the latch heads 91 relatively downward to a position where the surfaces 97 are inside the recess 98 to lock the latch heads in their inner, latched positions. Then the wireline tool 23 can be removed from the well 13 by withdrawing the coiled tubing 12. The armored cable 24, which extends along the outside after tubing, is reeled in at the same time.

Although catch and undercut shoulders have been disclosed as a means to connect the tool 80 to the retrieving head 85, other latching systems could be used. For example a system including an elongated external recess in the head and companion dogs on the lower ends of the sleeve fingers 90 could be used. Although a pair of diametrically opposed latch heads 91 have been shown, more than two head and resilient finger arrangements could be employed in various configurations so long as ample room is provided for the slot 81. The retaining pin 102 could be mounted at other elevations along the slot 81 in the housing 83.

Operation

In the operation and use of the present invention, the blowout preventer 17 is closed temporarily so that the threaded pin 62 of the side entry assembly 18 can be disconnected and the assembly lifted upward to provide working clearance. The adapter sub 21 is screwed onto the coupling 34 at the lower end of the coiled tubing 12, and the cable 24 is fed through the stuffing box 64, the inclined tube 25, the window 26, and to a point where its end is well below the adapter sub 21. Then the cable 24 is pushed through the passage 47 and the bore 48, after which the anchor assembly 51 is slid onto it and the armor wires cut and forced between the teeth 55 and the sleeve 56. The electrical connection 58 to the well tool 23 is prepared and made up, and then the anchor assembly 51 is pulled up inside the bore of the connector sub 22 to the position shown as the threads 60 are made up. The connector sub 22 then is attached to the adapter sub 21 by inserting the sub portion 37 into the bore 36 and then inserting the shear pins 42 as shown. The side entry assembly 18 then is lower and reconnected to the blowout preventer 17, which now can be opened to allow the injector 16 to drive the coiled tubing 12 into the well 13 through the stripper 19.

A light brake pressure is applied to the wireline winch 28 to cause the cable 24 to be under low tension as the coiled tubing 12 is run into the well. The cable 24 is pulled into the well 13 by the tubing 12, and extends alongside the same. At the appropriate depth the coiled tubing 12 is halted, and the well tool 23 is fired or otherwise operated by transmission of electric current or a signal through the cable conductor. As the coiled tubing 12 is being pulled out of the well by the injector 16, the winch 28 is operated at the same time to withdraw and rewind the cable 24. When the adapters 21 and 22 and tool 23 are above the blowout preventer 17, it is closed and the components are dissembled in the reverse of the order of assembly explained above.

Should the well tool 23 get stuck in the well for some reason, a strain can be taken in the coiled tubing 12 that is sufficient to shear the pins 42 and allow separation of the adapter sub 21 from the connector sub 22. The same pull can be used to disrupt the connection of the armor wires to the anchor assembly 51, as well as the electrical connector at 58. This permits the coiled tubing 12 and the wireline cable 24 to be removed from the well, and avoids a costly strip-over job.

When the embodiment shown in FIGS. 4 and 5 is used, the cable 76 is anchored in the connection sub 75 as shown in FIG. 2, and the electrical conductors therein connected to the plug of the wireline tool 23. The lower end portion 73 of the sub 70 is telescoped over the upper portion 74 of the connector member 75 with the cable 76 going through the slot 72 to the outside. The two shear pins 76 are driven into place to releasably connect the subs 70 and 75 to one another. The coiled tubing 12 then is forced into the well under pressure with the cable 76 running upward along the outside thereof. If it becomes desirable to remove only the coiled tubing 12, a strain is taken in the cable 76 that is sufficient to disrupt the pins 76. Then the cable 76 is lowered somewhat to allow the connector sub portion 74 to move downward and release from the portion 74 as the cable 76 moves completely out of the open-bottomed slot 72. At that point the wireline tool 23 and the sub 75 are suspended solely by the cable 76 so that the coiled tubing 12 and the adapter sub 70 can be removed from the well.

Although coiled tubing has been mentioned as a running string, the present invention can be used with other strings such as various sizes of tubing joints connected end-to-end. Indeed no special running string is required. The electrically operated or actuated well tool can be run under pressure and without killing the well. The wireline cable can be released from the anchor assembly at a predetermined pull on the cable, and the adapted sub 21 can be released at a predetermined pull on the tubing. The system is fast and easy to rig up at the well site, and is very economical to use. This invention takes advantage of both the strength of continuous or jointed tubing, and the accuracy and reliability of actuating well tools by electric wireline. The rigidity of the tubing permits tool operation in highly deviated wells where running on wireline cable alone is either very difficult, or entirely unworkable.

It now will be recognize that a new and improved adapter and connecter system that allows a wireline operated well tool to be run on coiled or other tubing, with the wireline extended outside the tubing. Since certain changes and modifications may be made in the disclosed embodiments without departing from the inventive concepts involved, it is the aim of the appended claims to cover all such changes and modifications falling within the true spirit and scope of the present invention.

What is claimed is:

1. Apparatus for allowing an electric wireline-operated well tool to be run into a well on armored cable and operated on tubing having a lower end within the well, comprising: a tubular housing assembly having upper and lower ends, said upper end being attached to the lower end of the tubing and said lower end being attached to the well tool; window means extending through the wall of said housing assembly so that the armored cable by which said tool is operated can extend from the outside said assembly to inside said assembly; means in said housing assembly for anchoring said armored cable thereto; and means in said housing assembly for electrically connecting said cable to the well tool.

2. The apparatus of claim 1 wherein said housing assembly includes upper and lower tubular members, said anchoring means and connecting means being located in said lower tubular member.

3. The apparatus of claim 2 further including releasable coupling means for coupling said upper and lower tubular members to one another.

4. The apparatus of claim 3 wherein said releasable coupling means includes shear means that is disrupt in response to a predetermined force.

5. The apparatus of claim 3 where said window means opens through the lower end of said upper tubular member so that release of said coupling means allows said cable to disengage from said window means and suspend said well tool independently of said tubing.

6. Apparatus for use in connection with the operation of an electric wireline well tool that is run into a well on tubing, comprising: a tubular adapter sub having an upper end and a lower end with said upper end being arranged to be attached to the tubing, said adapter sub having a bore and a wall between said bore and the outer surface of the sub, said adapter sub having a window through the wall; a tubular connector sub having an upper portion coupled to said lower end of said adapter sub and a lower portion arranged to be attached to said well tool, said upper portion having a central passage extending longitudinally therethrough, said lower portion having a bore in communication with said central passage; an armored electric cable extending from said exterior of said adapter sub through said window and down into said bore via said central passage, said cable having armor wires around a central core having at least one electrical conductor therein; means mounted in said bore for anchoring said armor wires to said connector sub; and means in said bore for electrically connecting said conductor to the said well tool.

7. The apparatus of claim 6 wherein said window is formed by a longitudinally extending slot having upward and outwardly inclined upper and lower ends.

8. The apparatus of claim 6 further including releasable means for coupling said lower end of said adapter sub to said upper portion of said connector sub, said releasable means being released in response to longitudinal force of a predetermined magnitude.

9. The apparatus of claim 8 where said releasable means includes radially arranged shear pins.

10. The apparatus of claim 6 wherein said anchoring means includes a mandrel having an axial passageway that is sized to slidably receive said cable; and means on the exterior of said mandrel for gripping end portions of said armor wires to secure said cable to said mandrel.

11. Apparatus for use in retrieving an electric wireline tool that has been lowered into a well bore on an armored electric cable, comprising: retrieving means adapted to be attached to the lower end of a tubular running string and lowered into the well therewith, said retrieving means including a generally tubular housing having a bore and wall and latch means arranged to automatically couple said housing to the wireline tool; longitudinal slot means through the wall of said housing and opening through the lower end thereof to enable said cable to pass upward into the bore of said housing and then outside said housing as said retrieving means is lowered; and means extending across said slot means for retaining said cable as said retrieving means is lowered.

12. The apparatus of claim 11 further including a head on said wireline tool having latch detent means thereon, and wherein said latch means including laterally shiftable latch elements cooperable with said detent means to couple said housing to said head.

13. The apparatus of claim 12 further including means for locking said latch elements in engagement with said detent means as said wireline tool is removed from the well by said running string.

14. The apparatus of claim 11 wherein said slot means has an upper end surface that inclines upward and outward.

15. The apparatus of claim 11 wherein said means for retaining said cable includes pin means engaged in aligned holes in said housing on opposite sides of said slot means.

16. A method of operating an electric wireline well tool that is run in a well on continuous or jointed tubing having a lower end within the well, comprising the steps of: connecting a tubular adapter means between the lower end of the tubing and the well tool, said adapter means having a wall and an opening through said wall; extending an end portion of an electric cable having armor wires and conductor means through said opening; establishing an electrical connection between said conductor means and said well tool to enable operation thereof in response to electrical signals; and lowering said well tool into a well with said cable extending outside of said tubing.

17. The method of claim 16 where said adapter means includes upper and lower members with said upper member having a lower end and said lower member having an upper end, and including the further step of releasably securing the lower end of said upper member to the upper end of said lower member to enable release of said members from one another in response to longitudinal force of a predetermined magnitude.

18. The method of claim 16 including the further step of anchoring said cable within said adapter means so that said cable is pulled into the well by said adapter means.

19. A method of retrieving a well tool that is suspended in a well on an armored electric cable, comprising the steps of: running a tubing string into the well alongside the cable, said tubing string having a retrieving tool attached to the lower end thereof, said retrieving tool having a tubular housing with a longitudinal slot opening through the lower end thereof; threading the cable through said slot so that the cable goes up through said lower end and then out through the upper end of said slot; retaining said cable with respect to said slot to prevent said cable from coming out of said slot as the retrieving tool passes down along said cable; operating said retrieving tool to latch the retrieving tool to said well tool; and then retrieving said well tool by pulling said tubing string and said cable out of the well.

* * * * *